US005486445A

United States Patent [19]

Van Dusen et al.

[11] Patent Number: 5,486,445

[45] Date of Patent: Jan. 23, 1996

[54] TONER AND DEVELOPER COMPOSITIONS WITH DIBLOCK COMPATIBILIZERS

[75] Inventors: John G. Van Dusen, Walworth; Timothy J. Fuller, Pittsford; Deborah M. Hudson, Rochester, all of N.Y.

[73] Assignee: Xerox Corporation, Stamford, Conn.

[21] Appl. No.: 283,427

[22] Filed: Aug. 1, 1994

[51] Int. Cl.[6] ..... G03G 9/097

[52] U.S. Cl. ..... 430/110

[58] Field of Search ..... 430/110

[56] References Cited

U.S. PATENT DOCUMENTS 4,557,991 12/1985 Takagiwa et al. ..... 430/109

4,814,253 3/1989 Gruber et al. ..... 430/106.6

4,997,739 3/1991 Tomono et al. ..... 430/110

5,229,242 7/1993 Mahabadi et al. ..... 430/106.6

5,324,611 6/1994 Fuller et al. ..... 430/109 X

*Primary Examiner*—Roland Martin

*Attorney, Agent, or Firm*—E. O. Palazzo

[57] ABSTRACT

A toner composition comprised of resin particles, pigment particles, wax component particles, and a compatibilizer comprised of a diblock polymer of hydrogenated polystyrene/polyisoprene or polystyrene/polybutadiene with isoprene/ethylene/isopentene/vinylbutene/vinyl-2-methylbutene groups or isoprene/ethylene/butene/and vinylbutene groups, and wherein the wax and diblock form domains of an average particle diameter of from about 0.1 to about 2 microns.

35 Claims, No Drawings

TONER AND DEVELOPER COMPOSITIONS WITH DIBLOCK COMPATIBILIZERS

BACKGROUND OF THE INVENTION

This invention is generally directed to toner and developer compositions, and more specifically, the present invention is directed to toner compositions, including magnetic, single component, two component and colored toner compositions wherein a diblock copolymer is selected for wax component dispersion enhancement, and wherein improved jetting characteristics are enabled with toners containing diblock polymers as compared to toners with elastic (elastomeric) modifiers, such as triblock, multi-arm and branched copolymers, or certain graft copolymers. It has been determined that certain diblock copolymers enable more rapid toner jetting rates, and furthermore, improve the minimum fusing temperatures of wax containing toners. In embodiments of the present invention, the toner compositions can contain at least two polymer resins, and in embodiments from about 2 to about 10 polymers comprised, for example, of a first resin, a second crosslinked resin, a wax component, and a block copolymer compatibilizer component. In an embodiment of the present invention, the toner compositions are comprised of resin particles, especially crosslinked extruded polyester resin particles, pigment particles, a wax component, such as polypropylene wax, and a diblock copolymer compatibilizer. There are also provided in accordance with the present invention positively or negatively charged toner compositions comprised of resin particles, pigment particles, a wax component, such as polypropylene wax, and certain diblock copolymer compatibilizers, and charge enhancing additives. In addition, the present invention is directed to developer compositions comprised of the aforementioned toners, and carrier particles. Furthermore, in another embodiment of the present invention there are provided single component toner compositions comprised of resin particles, magnetic components, such as magnetites, a wax component, such as polypropylene wax, and a block copolymer compatibilizer. The toner and developer compositions of the present invention are useful in a number of known electrostatographic imaging and printing systems, especially those systems wherein a wax is present in the toner. The toner compositions of the present invention, in embodiments, possess a wide fusing latitude, for example, about 100° C., which is the temperature range between the minimum fixing temperature of, for example, from about 100° C. to about 170° C. required for fixing toner particles on paper, and the hot offset temperature, for example, from about 180° C. to about 250° C., which is the temperature where molten toner adheres to the fuser roll. The toner compositions of the present invention also provide toner images with low surface energy and a low frictional coefficient, which properties enable the effective release of paper from the fuser roll and provide for a reduction in image smudging. Further, the developer compositions of the present invention possess stable electrical properties for extended time periods, and with these compositions, for example, there is no substantial change in the triboelectrical charging values. Also, with the toner compositions of the present invention, the wax, which enhances toner release from the fuser roll and increases fusing latitude, is retained therein and the loss of wax from the toner is eliminated or minimized; and moreover, the toner compositions of the present invention with stabilized wax domains are more easily processed by extrusion, and are more easily jetted which allows more rapid toner production and lower toner manufacturing costs. The control of wax concentration also enables the economy of direct recycling of toner fines obtained after particle size classification which would ordinarily be discarded as waste material. The dispersion stabilization of wax by diblock compatibilizers, described herein, decreases the minimum fusing and release temperature, thereby improving toner fusing latitude.

The following United States Patents are mentioned: 4,795,689 which discloses an electrostatic image developing toner comprising as essential constituents a nonlinear polymer, a low melting polymer, which is incompatible with the nonlinear polymer, a copolymer composed of a segment polymer, which is at least compatible with the nonlinear polymer, and a segment polymer, which is at least compatible with the low melting polymer, and a coloring agent, see the Abstract, and columns 3 to 10 for example; 4,557,991 which discloses a toner for the development of electrostatic images comprised of a certain binder resin, and a wax comprising a polyolefin, see the Abstract; also see columns 5 and 6 of this patent, and note the disclosure that the modified component shows an affinity to the binder and is high in compatibility with the binder, column 6, line 25; and as collateral interest 3,965,021.

Developer and toner compositions with certain waxes therein, which waxes can be selected as a component for the toners of the present invention, are known. For example, there are illustrated in U.K. Patent Publication 1,442,835, the disclosure of which is totally incorporated herein by reference, toner compositions containing resin particles, and polyalkylene compounds, such as polyethylene and polypropylene of a molecular weight of from about 1,500 to about 20,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. Also, in U.S. Pat. No. 4,997,739, there is illustrated a toner formulation including polypropylene wax ($M_w$ from about 200 to about 6,000) to improve hot offset. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

Described in U.S. Pat. No. 4,367,275 are methods of preventing offsetting of electrostatic images of the toner composition to the fuser roll, which toner subsequently offsets to supporting substrates such as papers wherein there are selected toner compositions containing specific external lubricants including various waxes, see column 5, lines 32 to 45. Also, U.S. Pat. Nos. 5,229,242, which illustrates toners with KRATON®, and 4,814,253 are of interest.

There are various problems observed with the inclusion of polyolefin or other waxes in toners. For example, when a polypropylene wax is included in toner to enhance the release of toner from a hot fuser roll, or to improve the lubrication of fixed toner image it has been observed that the wax does not disperse well in the toner resin. As a result, free wax particles are released during the pulverizing/jetting, or micronization step in, for example, a fluid energy mill and the pulverization rate is lower. The poor dispersion of wax in the toner resin and, therefore, the loss of wax will then impair the release function it is designed for. Scratch marks, for example, on xerographic developed toner solid areas caused by stripper fingers were observed as a result of the poor release. Furthermore, the free wax remaining in the developer will build up on the detone roll present in the xerographic apparatus causing a hardware failure.

The aforementioned problems, and others can be eliminated, or minimized with the toner compositions and processes of the present invention in embodiments thereof. The release of wax particles is, for example, a result of poor wax dispersion during the toner mechanical blending step. The toner additives should be dispersed well in the primary toner resin for them to impart their specific functions to the toner and thus the developer. For some of the additives, such as waxes like polypropylene, VISCOL 550P™ that become a separate molten phase during melt mixing, the difference in viscosity between the wax and the resin can be orders of magnitude apart, thus causing difficulty in reducing the wax phase domain size. A more fundamental reason for poor dispersion is due to the inherent thermodynamic incompatibility between polymers. The Flory-Huggins interaction parameter between the resin and the wax is usually positive (repulsive) and large so that the interfacial energy remains very large in favor of phase separation into large domains to reduce interfacial area. Some degree of success has been obtained by mechanically blending the toner formulation in certain types of mixers, such as the known Banbury mixer, where the temperature of melt can be maintained at a low level and polymer viscosities are similar. However, it has been found difficult to generate an effective wax dispersion in compounding extruders where melt temperatures are typically higher. The inclusion of a compatibilizer of the present invention is designed to overcome the inherent incompatibility between different polymers, and, more specifically, between toner resin and wax, thus widening the processing temperature latitude and enabling the toner preparation in a large variety of equipment, for example an extruder. The improvement in thermodynamic compatibility will also provide for a more stable dispersion of secondary polymer phase, such as wax, in the host resin against gross phase separation over time. The use of commercially available dispersants like Kraton G-1726 or D-1118, which contain triblock copolymers and high molecular weight components do not assist the thermodynamic stability and do not act as rubbery regions in the toner bulk. The elastic regions tend to create ductile fracture points and thereby reduce the jetting rate, and therefore contribute to increased cost of powder processing.

The toners of the present invention are effectively jettable, it is believed, because the specific copolymers added as wax compatibilizers disperse wax into domains less than, for example, 2 microns without toughening the toner composite of wax, wax dispersant, charge control agent and colorant. Moreover, the specific copolymers of the present invention are friable powders which enable better mixing of the toner components by extrusion processes.

A number of specific advantages are associated with the invention of the present application in embodiments thereof, including improving the dispersion of toner resin particles, especially a mixture of resins and wax; improving the dispersion of wax in the toner, thus eliminating the undesirable release of wax from the toner in the form of free wax particles during the pulverizing operation of the toner manufacturing process and the subsequent contamination of xerographic machine subsystems by free wax particles; avoiding pulverizing rate reduction resulting from the poor wax dispersion; maintaining the intended concentration of wax in the toner to provide enhanced release of toner images from the fuser roll and the avoidance of the undesirable scratch marks caused by the stripper fingers required for paper management; wide process latitudes during the mechanical blending operation of the toner manufacturing process; and effective mechanical blending of toner can be accomplished in a number of devices, including an extruder.

Illustrated in U.S. Pat. No. 5,229,242, the disclosure of which is totally incorporated herein by reference, are toner compositions comprised of resin particles, pigment particles inclusive of magnetites, waxes, and, for example, certain compatibilizers. More specifically, this patent discloses toner compositions comprised of first resin particles, second crosslinked resin particles, pigment particles, low molecular weight waxes, such as polyethylene, and polypropylene, such as those available from Sanyo Chemicals of Japan as VISCOL 550P™ and VISCOL 660P™, and the like, and as a compatibilizer a block or graft copolymer. Examples of compatibilizers illustrated in this patent include block or graft copolymers of the structures A-(block)-B, A-b-B-b-A or A-(graft)-B with the polymeric segments A and B each being compatible with a different polymer thereby permitting the compatibilizer to serve, for example, as a macromolecular surfactant. Examples of compatibilizers include block copolymers, such as the KRATON® copolymers, available from Shell Chemical Company, and STEREON® copolymers, available from Firestone Tire and Rubber Company. For example, KRATON G1701X®, a block copolymer of styreneethylene/propylene, KRATON G1726X®, a block copolymer of styrene-ethylene/butylene-styrene, KRATON G1652®, a block copolymer of styrene-ethylene/butylene-styrene, STEREON 730A®, a block copolymer of styrene and butadiene, and the like are suitable for improving the wax dispersion in styrenic resins. With KRATON G1701X®, the A segment could be the styrene block and the B segment could be an ethylene/propylene block. In embodiments of the invention of U.S. Pat. No. 5,229,242, there are provided toners wherein the compatibilizer is of the formulas A-b-B, A-b-B or A-g-B wherein A-b-B is a block copolymer of 2 segments, A and B, A-b-B-b-A is a block copolymer of 3-segments, A, B and A, and A-g-B is a graft copolymer of segments A and B, wherein the polymeric segment A is identical or compatible to one of the components present in the toner composition, that is the toner resin, whereas the polymeric segment B is identical or compatible with the other polymer component in the toner composition, that is, for example, the wax. Thus, in embodiments of the invention of U.S. Pat. No. 5,229,242, the aforementioned compatibilizer can be comprised of rigid units, such as styrene, with the polymeric segment B being comprised of flexible, rubber-like units, such as ethylene/propylene. The molecular weight of polymeric segment A can be from about 3,000 to about 100,000, and the molecular weight of polymeric segment B can be from about 5,000 to about 200,000. The compatibilizer is present in various effective amounts, such as, for example, from about 0.5 to about 9 percent, and preferably from about 1 to about 5 weight percent in embodiments.

Although the invention of U.S. Pat. No. 5,229,242 serves its intended purposes, improved wax compatibilizer compositions have been developed after extensive research and many failures. Toners with the diblocks of the present invention enable improved extruder mixing and processing, more rapid toner jetting rates, improved wax dispersions, and improved fusing properties at reduced cost. The wax compatibilizers of U.S. Pat. No. 5,229,242 may be considered thermoplastic elastomers, which indicates a material that at room temperature (25° C.) can be stretched repeatedly at least twice its original length and upon immediate release of the stress will return with force to its original approximate length. Although the elastomeric materials in the U.S. Pat. No. 5,229,242 do compatibilize wax, these high-molecular weight materials may also impart toughness and poor processing characteristics, such as poor toner jettability to the toner composite. Moreover, the aforementioned commercially available elastomeric materials are often mixtures of diblock and triblock copolymers which can possess counterproductive properties in toner applications.

Further, the commercially available resins of U.S. Pat. No. 5,229,242, when present in the toner between 2 and 5 weight percent, can adversely affect toner fusing and toner jetting rates. The glass transition temperatures of the diblocks of the present invention are less than 60° C. in embodiments, whereas those of the U.S. Pat. No. 5,229,242 are believed to be near 80° C.; the number of blocks for the polymers of the present invention are two, whereas those of U.S. Pat. No. 5,229,242 are 3, in many instances; the composition of diblock copolymers are, for example, less than 40 weight percent and are preferably between 20 and 35 weight percent of butadiene or isoprene wherein the diene components are either totally or partly hydrogenated, whereas those of U.S. Pat. No. 5,229,242 are usually more than 50 weight percent butadiene which are then completely hydrogenated. Because of the difficulty hydrogenating polystyrene-block-low molecular weight polyisoprene copolymers, it is believed that there are no effective commercially available styrene-hydrogenated isoprene block copolymers. The unique material compositions of the instant invention illustrated herein contain, for example, less than 50 weight percent olefin or hydrogenated olefin component and, therefore, are not elastomers.

In embodiments of the present invention, there are provided toners wherein the compatibilizer is a diblock copolymer of the formula A-b-B wherein A-b-B is a block copolymer of 2 segments, and wherein the polymeric segment A is compatible with one of the polymer components present in the toner composition, that is the toner resin like a polyester resin, and the polymeric segment B is compatible with the other polymer component in the toner composition, that is, for example, the wax. Thus, in embodiments the aforementioned compatibilizer can be comprised of rigid units such as styrene with the polymeric segment B being comprised of soft semicrystalline like units such as isoprene/ethylene/propylene/isopentene/vinyl-2-methylbutene. It is the unique composition of the A-b-B diblock copolymer which enables the substantially permanent dispersion of wax into the toner composite into dimensions less than 2 microns. The molecular weight of polymeric segment A can be from about 3,000 to about 50,000 and preferably near 20,000, and the molecular weight of polymeric segment B can be from about 1,000 to about 30,000, and preferably between 10,000 and 20,000. The compatibilizer is present in various effective amounts, such as, for example, from about 0.5 to about 5, and preferably from about 1 to about 3 weight percent in embodiments.

SUMMARY OF THE INVENTION

It is an object of the present invention to provide toner and developer compositions which possess many of the above noted advantages.

Another object of the present invention resides in the provision of toner and developer compositions with stable triboelectrical characteristics for extended time periods.

In another object of the present invention there are provided toner and developer compositions with excellent jetting rates, and which toners enable improved dispersion of resin and wax components achievable in a number of devices, including an extruder.

Another object of the present invention relates to the provision of toner and developer compositions with certain diblock compatibilizers, and wherein for the resulting toners there is avoided, or there is minimized the undesirable generation of particles comprised entirely of a secondary polymer component during toner preparation.

In a further object of the present invention the toner mechanical blending operation can be accomplished at a melt temperature as high as 50° C. above the melting point of the wax component, thus enabling the use of a large number of apparatuses in addition to a low melt temperature mixing process using equipment, such as a Banbury mixer, and wherein the toners are easily jettable.

In yet another object of the present invention the secondary polymeric phases in the toner will remain stable, and substantial phase separation, especially over extended time periods of, for example, up to three months in embodiments, will not take place.

Another object of the present invention provides that diblock copolymers of specific compositions, such as styrene-b-isoprene, its hydrogenated derivatives, such as ps-b-ethylene propylene, block copolymers of polystyrene with hydrogenated polybutadiene or polyisoprene, will enable reductions in the minimum fusing temperature of toners, including toner resins consisting of polyesters with polyolefin waxes.

Additionally, in yet another object of the present invention there are provided toner and developer compositions with certain waxes therein or thereon that enable images of excellent quality inclusive of acceptable resolutions, and that possess other advantages as illustrated herein such as low surface energy and excellent jetting rates.

Yet another object of the present invention resides in the provision of processes for the preparation of toner compositions wherein the undesirable escape of the wax contained therein is avoided or minimized.

These and other objects of the present invention can be accomplished in embodiments by providing toner and developer compositions. More specifically, the present invention is directed to toner compositions comprised of resin particles, pigment particles inclusive of magnetites, waxes, and as compatibilizer a diblock copolymer. In embodiments of the present invention, there are provided toner compositions comprised of first resin particles, second crosslinked resin particles, pigment particles, low molecular weight waxes, such as polyethylene, and polypropylene, such as those available from Sanyo Chemicals of Japan as VISCOL 550P™ and VISCOL 660P™, Mitsui "Hi-wax" NP055 and NP105, or wax blends such as MicroPowders, Micropro-440 and 440w, and the like, and as a compatibilizer, certain diblock copolymers. Furthermore, there are provided in accordance with the present invention positively charged toner compositions comprised of resin particles, pigment particles, low molecular weight waxes, a diblock copolymer compatibilizer, and a charge enhancing additive. Another embodiment of the present invention is directed to developer compositions comprised of the aforementioned toners, and carrier particles.

In addition, in accordance with embodiments of the present invention, there are provided developer compositions comprised of toner compositions containing first resin particles like a styrene butadiene resin, optional second crosslinked resins of, for example, a styrene methacrylate crosslinked with known components, such as divinylbenzene, pigment particles, such as MAPICO BLACK™, magnetites, carbon blacks or mixtures thereof, low molecular weight waxes, such as polyethylene, and polypropylene, such as those available from Sanyo Chemicals of Japan as VISCOL 550P™ and VISCOL 660P™, Mitsui "Hi-wax" NP055 and NP105, or wax blends, such as MicroPowders, Micropro-440 and 440w, a compatibilizer comprised of a hydrogenated polystyrene/polyisoprene, or a polystyrene/polybutadiene diblock copolymer, and an optional charge enhancing additive, particularly, for example, distearyl dimethyl ammonium methyl sulfate, reference U.S. Pat. No. 4,560,635, the disclosure of which is totally incorporated herein by reference, and carrier particles. As carrier components for the aforementioned compositions, there can be selected a number of known materials like steel, iron, or ferrite, particularly with a polymeric coating thereover including copolymers of vinyl chloride and trifluorochloroethylene with conductive substances dispersed in the polymeric coating inclusive of, for example, carbon black.

Illustrative examples of suitable toner resins selected for the toner and developer compositions of the present invention, and present in various effective amounts, such as, for example, from about 65 percent by weight to about 95 percent by weight, include styrene acrylates, styrene methacrylates, styrene butadienes, styrene isoprenes, polyesters, polyamides, epoxy resins, polyurethanes, polyolefins, vinyl resins, polymeric esterification products of a dicarboxylic acid and a diol comprising a diphenol; crosslinked resins; and mixtures thereof. Various suitable vinyl resins may be selected as the toner resin including homopolymers or copolymers of two or more vinyl monomers. Typical vinyl monomeric units include styrene, p-chlorostyrene, vinyl naphthalene, unsaturated monoolefins, such as ethylene, propylene, butylene, isobutylene and the like; vinyl halides, such as vinyl chloride, vinyl bromide, vinyl fluoride, vinyl acetate, vinyl propionate, vinyl benzoate, and vinyl butyrate; vinyl esters, such as esters of monocarboxylic acids including methyl acrylate, ethyl acrylate, n-butyl acrylate, isobutyl acrylate, dodecyl acrylate, n-octyl acrylate, 2-chloroethyl acrylate, phenyl acrylate, methylalphachloroacrylate, methyl methacrylate, ethyl methacrylate, and butyl methacrylate; acrylonitrile, methacrylonitrile, acrylamide; vinyl ethers, such as vinyl methyl ether, vinyl isobutyl ether, and vinyl ethyl ether; N-vinyl indole; N-vinyl pyrrolidone; and the like. The styrene butadiene copolymers, especially styrene butadiene copolymers prepared by a suspension polymerization process, reference U.S. Pat. No. 4,558,108, the disclosure of which is totally incorporated herein by reference, can be selected as the toner resin in embodiments.

As one toner resin, there can be selected the esterification products of a dicarboxylic acid and a diol comprising a diphenol, which components are illustrated in U.S. Pat. No. 3,590,000, the disclosure of which is totally incorporated herein by reference. Other toner resins include styrene/methacrylate copolymers, styrene/acrylate copolymers, and styrene/butadiene copolymers, especially those as illustrated in the aforementioned patent; and styrene butadiene resins with high styrene content, that is exceeding from about 80 to 85 percent by weight of styrene, which resins are available as PLIOLITES® and PLIOTONES® obtained from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol. In embodiments, the toner is comprised of a mixture of resins comprised, for example, of a first resin as illustrated herein like styrene acrylate, styrene methacrylate, or styrene butadiene with a high styrene content, and a second polymer comprised of a crosslinked copolymer of styrene and butyl methacrylate. The aforementioned mixture of first and second resins can contain various effective amounts of each resin, for example from about 50 to about 90, and preferably about 70 weight percent of the first resin like styrene butadiene, and from about 50 to about 10, and preferably about 30 weight percent of the second resin, like the resin crosslinked with, for example, divinylbenzene. Preferred toner resins include the extruded polyesters of U.S. Pat. No. 5,376,494, and U.S. Pat. No. 5,227,460 the disclosures of which are totally incorporated herein by reference.

Numerous well known suitable pigments can be selected as the colorant for the toner particles including, for example, carbon black like REGAL 330®, BLACK PEARLS®, VULCAN®, and the like, nigrosine dye, aniline blue, phthalocyanine derivatives, magnetites, and mixtures thereof. The pigment, which is preferably carbon black, should be present in a sufficient amount to render the toner composition colored thereby permitting the formation of a clearly visible image. Generally, the pigment particles are present in amounts of from about 1 percent by weight to about 20 percent by weight, and preferably from about 4 to about 10 weight percent, based on the total weight of the toner composition, however, lesser or greater amounts of pigment particles may be selected in embodiments.

When the pigment particles are comprised of known magnetites, including those commercially available as MAPICO BLACK®, they are usually present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black.

In another embodiment of the present invention, there are provided colored toner compositions containing as pigments or colorants known magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as CI 60710, CI Dispersed Red 15, a diazo dye identified in the Color Index as CI 26050, CI Solvent Red 10, LITHOL SCARLETT™, HOSTAPERM™, and the like. Illustrative examples of cyan materials that may be used as pigments include copper tetra-4(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, Sudan Blue, and the like; while illustrative examples of yellow pigments that may be selected include diarylide yellow 3,3-dichlorobenzidene acetoacetanilides, a monazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. Also, there may be selected red, green, blue, brown, and the like pigments. These pigments are generally present in the toner composition in an amount of from about 2 weight percent to about 15 weight percent, and preferably from about 2 to about 10 weight percent based on the weight of the toner resin particles.

Examples of low molecular weight, for example from about 1,000 to about 20,000, and preferably from about 1,000 to about 7,000, waxes include those as illustrated in British Patent Publication 1,442,835, such as polyethylene, polypropylene, and the like, especially VISCOL 550P™ and VISCOL 660P™. The aforementioned waxes, which can be obtained in many instances from Sanyo Chemicals of Japan, are present in the toner in various effective amounts, such as for example from about 0.5 to about 10, and preferably from about 3 to about 7 weight percent. Examples of functions of the wax are to enhance the release of paper after fusing, and providing the fused toner image with lubrication. The release or separation of wax from the toner can reduce these functions. Also, toners with poor wax dispersion have a lower pulverizing rate and the free wax, which can remain with the toner, will build up on the internal parts of the xerographic cleaning device causing a machine failure.

The wax compatibilizers generally are comprised of hydrogenated, partly hydrogenated, and especially mostly, up to 90 percent, for example, and, more specifically, from about 45 to about 90 percent, hydrogenated polystyrene/polyisoprene diblock copolymers, and polystyrene/polybutadiene diblock copolymers. Some of these block copolymers were supplied by Shell Chemicals, Houston Tex., while others were prepared. Diblock copolymers with, for example, weight average molecular weights in the range of 10,000 to 80,000 and preferably with a $M_w$ of between 15,000 and 50,000, dependent on the toner resin employed can be selected. Polystyrene segment molecular weights are typically between 5,000 and 50,000 with a preferred $M_w$ such that the overall polystyrene content for the block content for the block copolymer is from about 30 to 80 mole percent. Isoprene or butadiene segments typically have a $M_w$ of 5,000 to 40,000 with preferred values between 10,000 and 20,000. Hydrogenation especially of the isoprene or the butadiene segment is typically accomplished to an extent of between 40 and 99 mol percent as estimated by $^1$H NMR procedures. Effectiveness of the compatibilizer in its stabilization of the wax dispersion, especially during melt extrusion processing of toner, was found to be related to both the level of hydrogenation and segment molecular weight. The polystyrene block represents, for example, more than 30 weight percent but less than 80 weight percent of the weight of the diblock copolymer.

Specific examples of block copolymers for dispersing wax in polyester, such as reactive extruded polyesters, reference U.S. Pat. No. 5,227,460 and U.S. Ser. No. 814,641, the disclosures of which are totally incorporated herein by reference, include polystyrene with a $M_w$ of 10,000 to 40,000; block-partly or fully hydrogenated polyisoprene, between 10,000 and 40,000 $M_w$, copolymer; polystyrene, about 20,000 $M_w$ block-fully hydrogenated polyisoprene; copolymers of polystyrene, about 20,000 $M_w$, block-partly hydrogenated polyisoprenes of about 10,000 $M_w$; polystyrene, about 20,000 $M_w$, block-hydrogenated polyisoprene, about 20,000 $M_w$, copolymer; polystyrene, about 20,000 $M_w$, block-partly hydrogenated polyisoprene, about 20,000 $M_w$, copolymer; polystyrene, about 20,000 $M_w$, block-hydrogenated polybutadiene, about 10,000 $M_w$, copolymer; polystyrene, about 20,000 $M_w$, block-partly hydrogenated polybutadiene, about 10,000 $M_w$; styrene-b-isoprene; hydrogenated styrene-b-isoprene; ps-b-ethylene propylene; polystyrene, about 20,000 $M_w$, block-hydrogenated polybutadiene, about 20,000 $M_w$, copolymer; polystyrene, about 20,000 $M_w$, block-partly hydrogenated polybutadiene, about 20,000 $M_w$, copolymer; about 20,000 $M_w$, polystyrene-polybutadiene or polyisoprene multiblock copolymer; and about 20,000 $M_w$, polystyrene-hydrogenated polybutadiene polyisoprene multi-block copolymers of the formulas $$-\{-CH_2CH(Phenyl)\}_{192}\text{-block-}[-\{CH_2CH{=}C(CH_3)\text{-}CH_2\text{-}\}_a\text{-}\{\text{-}CH_2\text{-}CH\text{-}(CCH_3{=}CH_2)\text{-}\}_b b\ \text{-}\{CH_2\text{-}CH_2\text{-}CH(CH_3)CH_2\text{-}\}_c\text{-}\{CH_2\text{-}CH\text{-}(CHCH_3\text{-}CH_3)\text{-}\}d\text{-}]$$

where a=138-(b+c),b+d=9, a+b+c+d=147, and23 <(c+d) <133;

and $$-\{-CH_2CH(Phenyl)\}_x\text{-block-}[-\{CH_2CH{=}C(CH_3)\text{-}CH_2\text{-}\}_a\text{-}\{\text{-}CH_2\text{-}CH\text{-}(CCH_3{=}CH_2)\text{-}\}_b\text{-}\{CH_2\text{-}CH_2\text{-}CH(CH_3)CH_2\text{-}\}_c\text{-}\{CH_2\text{-}CH\text{-}(CHCH_3\text{-}CH_3)\text{-}\}d\text{-}]$$

where 28<x<481, 14<(a+b+c+d)<441, b+d<0.1(a+b+c+d), and (c+d)>0.5(a+b+c+d).

The extent of hydrogenation for a number of the toner resins tested varied between 0 and 90 mol percent of the block copolymer isoprene moleties dependent, for example, on reaction conditions. The extent of hydrogenation for the butadiene moieties ranges between 0 and 100 mol percent. Excellent wax compatibilization results are achieved with block copolymers with a higher mol percent hydrogenation, for example more than 50 percent.

A block copolymer preferred in embodiments of the present invention is a polystyrene (20,000)-block-polyisoprene (10,000) copolymer. With $^1$H NMR spectrometry, there was investigated two methods to hydrogenate the polyisoprene segment with Wilkinson's catalyst and diimide, and wherein with the catalyst there is hydrogenated approximately 63 percent of the isoprene groups within 3 days. Advantages to the diblock copolymers of the instant invention include ease of preparation, excellent wax compatibilization at low concentrations, easier processing by extrusion because the block copolymers of the instant invention are brittle powders rather than rubbery or elastomeric prill, and improved mechanical properties of toner composites which allow improved jettability to toner dimension.

Examples of block copolymers of the structure A-(block)-B with the polymeric segments A being polystyrene and B being completely or partly hydrogenated butadiene isoprene polymer can be prepared from the KRATON G® type linear series available from Shell Chemical Company. In embodiments, the aforementioned compatibilizer can be comprised of rigid units, such as styrene, with the polymeric segment B being comprised of soft, semicrystalline units, such as ethylene/propylene/butylene/isopentene/vinyl-2-methylbutene. The molecular weight of polymeric segment A can be from about 5,000 to about 80,000, and the molecular weight of polymeric segment B can be from about 1,000 to about 40,000. The compatibilizer is present in various effective amounts, such as for example from about 0.5 to about 10 percent, and preferably from about 1 to about 5 weight percent in embodiments.

Illustrative examples of optional charge enhancing additives present in various effective amounts, such as for example from about 0.1 to about 20, and preferably from 1 to about 5 percent by weight, include alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; negative charge control agents such as di-t-butylaluminum salicylate, Alohas or BONTRON E-88® (available from Hodogaya), E-84® (available from Hodogaya), tetraphenylphosphonium tetrafluoroborate, and other known similar charge enhancing additives; and the like.

With further respect to the toner and developer compositions of the present invention, a component that may be present therein is the linear polymeric alcohol comprised of a fully saturated hydrocarbon backbone with at least about 80 percent of the polymeric chains terminated at one chain end with a hydroxyl group, which alcohol is represented by the following formula $CH_3(CH_2)_nCH_2OH$ wherein n is a number of from about 30 to about 300, and preferably of from about 30 to about 100, which alcohols are available from Petrolite Corporation. Particularly preferred polymeric alcohols include those wherein n represents a number of from about 30 to about 50. Therefore, in a preferred embodiment of the present invention the polymeric alcohols selected have a number average molecular weight as determined by gas chromatography of from about greater than 450 to about 1,400, and preferably of from about 475 to about 750. In addition, the aforementioned polymeric alcohols can be present in the toner and developer compositions illustrated herein in various effective amounts, and can be added as uniformly dispersed internal, or as finely divided uniformly dispersed external additives. More specifically, the polymeric alcohols can be present in an amount of from about 0.05 percent to about 20 percent by weight. Therefore, for example, as internal additives the polymeric alcohols are present in an amount of from about 0.5 percent by weight to about 20 percent by weight, while as external additives the polymeric alcohols are present in an amount of from about 0.05 percent by weight to slightly less than about 5 percent by weight. Toner and developer compositions with the waxes present internally are formulated by initially blending the toner resin particles, pigment particles, and polymeric alcohols, and other optional components. By contrast, when the polymeric alcohols are present as external additives, the toner composition is initially formulated and comprised of, for example, resin particles and pigment particles; and subsequently there are added thereto finely divided polymeric alcohols.

Illustrative examples of carrier particles that can be selected for mixing with the toner compositions of the present invention include those particles that are capable of triboelectrically obtaining a charge of opposite polarity to that of the toner particles. Accordingly, the carrier particles can be selected so as to be of a negative polarity thereby enabling the toner particles, which are positively charged, to adhere to and surround the carrier particles. Alternatively, there can be selected carrier particles with a positive polarity enabling toner compositions with a negative polarity. Illustrative examples of known carrier particles that may be selected include granular zircon, granular silicon, glass, steel, nickel, iron, ferrites like copper zinc ferrites, available from Steward Chemicals, and the like. The carrier particles may include thereon known coatings like fluoropolymers, such as KYNAR®, polymethylacrylate, and the like. Examples of specific coatings that may be selected include a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride, and trichlorofluoroethylene; and other known coatings. There can also be selected as carriers components comprised of a core with a mixture, especially two, polymer coatings thereover, reference U.S. Pat. Nos. 4,937,166 and 4,935,326, the disclosures of which are totally incorporated herein by reference. Examples of carrier particles disclosed in the aforementioned patents can be prepared by (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000 microns, and preferably from about 75 to about 200 microns, thus allowing these particles to possess sufficient density and inertia to avoid adherence to the electrostatic images during the development process. The carrier particles can be mixed with the toner particles in various suitable combinations, such as from about 1 to about 3 parts per toner to about 100 parts to about 200 parts by weight of carrier.

The toner compositions of the present invention can be prepared by a number of known methods, including mechanical blending and melt blending the toner resin particles, pigment particles or colorants, compatibilizers, optional additives, and polymeric waxes followed by mechanical attrition including classification. Other methods include those well known in the art such as spray drying, mechanical dispersion, melt dispersion, dispersion polymerization, and suspension polymerization. The toner particles are usually pulverized and classified, thereby providing a toner with an average volume particle diameter of from about 7 to about 25, and preferably from about 10 to about 15 microns as determined by a Coulter Counter. The toner compositions of the present invention are particularly suitable for preparation in a compounding extruder such as a corotating intermeshing twin screw extruder of the type supplied by the Werner & Pfleiderer Company of Ramsey, N.J. The inclusion of compatibilizer can improve the thermodynamic compatibility between the primary and the secondary polymer phases. As a result, the secondary polymer can be well dispersed into smaller domain size with improved adhesion to the primary resin. The smaller domain size of typically less than 2 microns and the better adhesion will then prevent the secondary polymer from separating into individual particles during the pulverization operation. Wax domain sizes preferred for optimum extrusion, jetting, and fusing and release function are from 0.1 micron to 2.0 microns in diameter. Domain sizes experienced without the use of a compatibilizer are typically 0.5 to 10 microns and generally have a broad size distribution. Furthermore, the compatibilizing action can be effected even at high melt temperatures, for example 50° C. above the melting point of the wax component, when mechanical blending is difficult because of vast differences in polymer and wax viscosities. This advantage increases the process latitude of the mechanical blending operation. The advantage of including a compatibilizer may not be limited to the mechanical blending process alone; thus, for example, improved dispersion and adhesion can be realized in other known preparation methods by using the toner compositions of the present invention. Also, high concentrations of a secondary polymer, such as wax, can be effectively dispersed in a toner by including an effective amount of compatibilizer. Jetting rates, especially for styrene-acrylate and polyester binder resins, are reduced by 50 percent to 80 percent when commercial triblock, or certain graft copolymers are used as compatibilizers. With the diblock wax compatibilizers described herein, the toner jetting rates can be maintained, for example, at 90 percent to 110 percent of that for the binder resin alone. Thus, there is a significant cost advantage realized from the processing time required for grinding and jetting operations in toner manufacturing. The improvement in jetting rate with diblock copolymers of the instant invention can be between 1.25 and 2 times faster than with that obtained using the U.S. Pat. No. 5,229,242 compatibilizers. The jetting rate advantage with fewer toner fines produced amounts to more than a two-fold reduction in cost of the toner.

The toner and developer compositions of the present invention may be selected for use in developing images in electrostatographic imaging systems containing therein, for example, conventional photoreceptors, such as selenium and selenium alloys. Also useful, especially wherein there are selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, titanyl phthalocyanines, and vanadyl phthalocyanines, while examples of charge transport layers include the aryl amines as disclosed in U.S. Pat. No. 4,265,990, the disclosure of which is totally incorporated herein by reference. Moreover, there can be selected as photoconductors hydrogenated amorphous silicon, and as photogenerating pigments squaraines, perylenes, and the like.

The toner and developer compositions of the present invention can be particularly useful with electrostatographic imaging apparatuses containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone.

The following examples are provided wherein parts and percentages are by weight unless otherwise indicated. A comparative Example III is also provided.

EXAMPLE I

A toner composition comprised of 89 percent by weight of a branched bisphenol A-fumarate, polyester resin, where the estimated level of branched chains is between 5 and 40 percent, 4 percent by weight of the polypropylene wax VISCOL 550P™, available from Sanyo Chemicals of Japan, 5 percent by weight of REGAL 330® carbon black obtained from Cabot Inc., and 2 percent by weight of a styrene isoprene diblock copolymer containing about 30 percent isoprene segments, and which had been hydrogenated to convert about 60 percent (based on $^1$H NMR) of the isoprene segments to ethylene propylene units by the following process was prepared by mechanically blending the aforementioned components.

Hydrogenation of polystyrene (20,000 $M_w$) block-polyisoprene (10,000 $M_w$) using Wilkinson's Catalyst. PS-b-PIS resin (80 grams), triphenylphosphine (7 grams), and tris-(triphenylphosphine)rhodium(I) chloride (0.9 gram) were allowed to dissolve in toluene (200 grams)in a Parr pressure reactor (500 milliliters). The vessel was purged with argon and pressurized to 20 psi with argon and then to 1,200 psi with hydrogen. The reaction mixture was then heated to 100° C. with stirring for 3 days. After cooling to 25° C., the reaction vessel was cautiously vented and the reaction solution was added to 4 liters of methanol to coagulate the polymer using a Waring blender. The solid polymer, collected by filtration, was then redispersed in hexanes (250 milliliters) until the mixture became too thick to stir using the Waring blender. Methanol (800 milliliters) was added and the polymer that coagulated in small particles was filtered and then washed with methanol (3.5 liters). The yield of dried product (polystyrene-b-ethylene-propylene) was 78 grams. The residual polyisoprene double bonds detected in the resultant polystyrene (20,000 $M_w$) block-partly hydrogenated-polyisoprene (10,000 $M_w$) using $^1$H NMR were 15.60 mol percent implying that 63.38 percent of the initial 42.60 mot percent isoprene double bonds were hydrogenated. The product was polystyrene (20,000 $M_w$) block-poly [15.60 mol percent-isoprene-27 mol percent hydrogenated isoprene, ethylene-propylene-6.3 percent-isopentene)] copolymer. When the hydrogenation reaction was accomplished for 16 hours at 100° C. rather than for 72 hours as described above, a polymer was obtained in which 33.76 percent of the initial 42.60 mol percent isoprene double bonds were hydrogenated. The product was polystyrene, 20,000 $M_w$ block-poly[28.22 mol percent-isoprene-14.4 mol percent hydrogenated isoprene like ethylene-propylene-6.3 percent-isopentene].

The above prepared hydrogenated product material was isolated by precipitation into a 5× volume of methanol, and dried to constant weight in a vacuum (<10 mTorr), and the granular product used in the following melt blending procedure. Using a Werner and Pfleiderer ZSK-28 twin screw extruder at barrel set temperatures ranging from 90° to 120° C., the toner melt-mixing was accomplished at a throughput rate of 5 to 10 pounds/hour.-After pulverization and classification, toner particles with volume average diameter of about 4 to 9 microns as measured by a Coulter Counter were obtained. Jetting rates were calculated from collection yields, and found to be 21 to 24 pounds/hour. Similar jetting rate calculations for toner with 4 percent KRATON G-1726® of Example III indicated a collection rate of 17 pounds/hour, (or about 80 percent of that of the pure diblock) down to 13 pounds/hour upon scale up to 200 liter AFG grinding equipment.

The percent by weight of the free wax particles was determined to be less than the detection limit of 0.1 percent by weight for the toners prepared, using a centrafugal density separation technique. The percent of total wax was estimated by differential scanning calorimetry and found to equal the 4 percent preprocess concentration. Wax domain size was estimated, from TEM photo analysis, to be on average 1.2 microns in diameter with a standard deviation of 0.8 micron. Wax diameters from comparative toners without compatibilizer have a mean value of 5.4 μm with a standard deviation of 2.4 microns.

Subsequently, there was prepared a developer composition by admixing the aforementioned formulated toner composition mechanically blended at 73° F. at a 3.0 percent toner concentration, that is 3.0 parts by weight of toner per 100 parts by weight of carrier comprised of a steel core, 90 microns in diameter, with a coating, 0.8 weight percent, thereover of polyvinylidine flouride and polymethyl methacrylate. Thereafter, the formulated developer composition was incorporated into an electrostatographic imaging device with a toner transporting means, a toner metering charging means, and a development zone as illustrated in U.S. Pat. No. 4,394,429. A test run of 10,000 copies was accomplished. The copy quality was judged, against a Xerox Corporation 1075 control developer with no compatibilizer, to be excellent with complete solid area density, also comparable to control data, and no measured background throughout the aforementioned imaging test. The paper was released easily, during a 10,000 copy run, after the toner image was fused. Fusing conditions for the imaging device were varied so as to determine the minimum fix temperature behavior from the developed image. Fusing evaluation by a standard image crease test was performed, and the minimum fix temperature of the toner was found to be F=–35° C. compared to an F=–19° C. to –20° C. for the same toner without this compatibilizer (A more negative value of "F" representing a lower fusing temperature).

EXAMPLE II

A toner was prepared by repeating the toner melt mixing procedure of Example I, with the exception that the diblock, styreneethylene/propylene block copolymer, obtained from Shell Chemical, was selected as the compatibilizer, at 5 percent by weight of premix concentration. This material was found to contain fifty mole percent styrene units with 50 percent ethylene, propylene units, and was reported to have a molecular weight $M_w$ of 80,000. This toner was analyzed, using a centrafugal density separation technique for the percent by weight of the free wax particles and determined to be less than our detection limit of 0.1 percent by weight for all toners prepared. The percent of total wax was estimated by differential scanning calorimetry and found to equal the 4 percent preprocess concentration. Wax domain size was estimated, from TEM photo analysis, to be on average, less than 0.9 micron in diameter with a standard deviation of 0.4 micron. Wax diameters from comparative toners without compatibilizer have a mean value of 5.4 microns with a standard deviation of 2.4 microns.

Subsequently, there was prepared a developer composition by admixing the aforementioned formulated toner composition mechanically blended at 72° C. at a 3 percent toner concentration, that is 3.0 parts by weight of toner per 100 parts by weight of carrier comprised of a steel core, 90 microns diameter, with a coating, 0.8 weight percent, thereover of polyvinylidine flouride and polymethyl methacrylate. Thereafter, the formulated developer composition was incorporated into an electrostatographic imaging device with a toner transporting means, a toner metering charging means, and a development zone as illustrated in U.S. Pat. No. 4,394,429. A test run of 1,500 copies was accomplished. The copy quality was judged excellent, as per the methods used in Example I, with complete, uniform solid area and lines, and no measured background throughout the aforementioned imaging test. Fusing conditions for the imaging device were varied so as to determine the minimum fix temperature behavior from the developed image. The paper was released easily after the toner image was fused and no scratching was caused by stripper fingers present in the imaging device on developed solid areas as determined by visual examination. Fusing evaluation by a standard image crease test was performed, and the minimum fix temperature found to be F=–32° C. compared to an F=–19° C. for toner without this compatibilizer and a more negative value of "F" representing a lower fusing temperature.

EXAMPLE III (COMPARATIVE)

Two toners were prepared by repeating the procedure of Example I with the exception that a commercial block copolymer (Shell KRATON G 1726X®) was selected at 2 percent by weight and at 4 percent by weight as compatibilizer for a 4 percent VISCOL 660P™ wax formulation, instead of the pure, styrene-isoprene diblock copolymer. This prior art compatibilizer was comprised of 70 percent of diblock and 30 percent of styrene-ethylene/butylene-styrene tribiock as per the coupling of diblock chains during its manufacture. A toner jetting rate of 15 pounds/hour was observed for the 2 percent compatibilizer toner and a rate estimated to be less than 13 pounds/hour for the 4 percent toner. Wax domain size was estimated, per TEM procedures used in Examples I and II, to average 1.8 microns (microns, in average volume diameter) with a standard deviation of 2.4 microns.

Subsequently, there was prepared a developer composition by admixing the aforementioned formulated toner composition mechanically blended at 73° F. at a 3.0 percent toner concentration. The prepared developer composition was then incorporated into the same electrostatographic imaging device of Example I, and a test run of 2,000 copies was accomplished. The copy quality for the developed images was excellent throughout the test. The paper was released easily after fusing. Fusing evaluation was performed by a standard crease test method. Minimum fusing temperature was found to have an F=–23° C. to –24° C. or 8° C. to 12° C. higher than that of the test toners in Examples I and II.

Other modifications of the present invention may occur to those skilled in the art subsequent to a review of the present application. The aforementioned modifications, including equivalents thereof, are intended to be included within the scope of the present invention.

What is claimed is:

1. A toner composition consisting essentially of first resin particles, optional second crosslinked resin particles, pigment, wax component particles, and a compatibilizer comprised of a diblock polymer of partially hydrogenated polystyrene/polyisoprene or a partially hydrogenated polystyrene/polybutadiene.

2. A toner composition in accordance with claim 1 wherein the compatibilizer polystyrene/polyisoprene is completely hydrogenated.

3. A toner composition in accordance with claim 1 wherein the compatibilizer polystyrene/polyisoprene is partially hydrogenated at from between 25 and 90 percent of the available isoprene double bonds.

4. A toner composition [in accordance with claim 2] consisting essentially of resin particles, pigment, wax component particles, and a diblock compatibilizer, and wherein the compatibilizer is of the formula $$-\{-CH_2CH(Phenyl)\}_{192}\text{-block-}[-\{CH_2CH{=}C(CH_3)\text{-}CH_2\text{-}\}_a\text{-}\{\text{-}CH_2\text{-}CH\text{-}(CCH_3{=}CH_2)\text{-}\}_b\text{-}\{CH_2\text{-}CH_2\text{-}CH(CH_3)CH_2\text{-}\}_c\text{-}\{CH_2\text{-}CH\text{-}(CHCH_3\text{-}CH_3)\text{-}\}d\text{-}]$$

where a=138-(b+c),b+d=9, a+b+c+d=147, and23<(c+d)<133.

5. A toner composition in accordance with claim 1 wherein the compatibilizer is of the formula wherein the polystyrene block represents more than 50 weight percent but less than 80 weight percent of the weight of the diblock polymer $$-\{-CH_2CH(Phenyl)\}_x\text{-block-}[-\{CH_2CH{=}C(CH_3)\text{-}CH_2\text{-}\}_a\text{-}\{\text{-}CH_2\text{-}CH\text{-}(CCH_3{=}CH_2)\text{-}\}_b\text{-}\{CH_2\text{-}CH_2\text{-}CH(CH_3)CH_2\text{-}\}_c\text{-}\{CH_2CH\text{-}(CHCH_3\text{-}CH_3)\text{-}\}_d\text{-}]$$

where 28<x<481, 14<(a+b+c+d)<441, b+d<0.1(a+b+c+d), and (c+d)>0.5(a+b+c+d).

6. A toner composition in accordance with claim 1 wherein the compatibilizer is present in an amount of from about 0.5 to about 10 weight percent.

7. A toner composition in accordance with claim 1 wherein the compatibilizer is present in an amount of from about 1 to about 3 percent.

8. A toner composition in accordance with claim 1 wherein the resin particles are selected from the group consisting of polyesters, styrene butadiene copolymers, styrene acrylate copolymers, and styrene methacrylate copolymers.

9. A toner composition in accordance with claim 8 wherein the polyester results from the condensation reaction of dimethylterephthalate, 1,2-propanediol, 1,3-butanediol, and pentaerythritol; or wherein the polyester results from the condensation reaction of dimethylterephthalate, 1,2-propanediol, diethylene glycol, and pentaerythritol.

10. A toner composition in accordance with claim 8 wherein the styrene butadiene copolymer contains 91 percent by weight of styrene, and 9 percent by weight of butadiene.

11. A toner composition in accordance with claim 8 wherein there is selected a suspension polymerized styrene butadiene.

12. A toner composition in accordance with claim 1 wherein the first resin particles are present in an amount of from about 40 to about 90 weight percent, and the second resin particles are present in an amount of from about 60 to about 10 weight percent.

13. A toner composition in accordance with claim 1 wherein the first resin particles are [comprised] selected from the group consisting of styrene butadiene, styrene acrylate, [or] and styrene methacrylate.

14. A toner composition in accordance with claim 1 wherein the second resin particles are [comprised] selected from the group consisting of a crosslinked polymer of styrene butadiene, styrene acrylate, [or] and styrene methacrylate.

15. A toner composition in accordance with claim 1 wherein the first resin is present in an amount of from about 50 weight percent to about 85 weight percent, and the second resin is present in an amount of from about 10 weight percent to about 40 weight percent.

16. A toner composition in accordance with claim 1 wherein the pigment is selected from the group consisting of carbon black, magnetite, [MAPICO BLACK™ or] and mixtures thereof.

17. A toner composition in accordance with claim 1 wherein the pigment is selected from the group consisting of magenta, cyan, yellow, and mixtures thereof.

18. A toner composition in accordance with claim 1 wherein the wax has a weight average molecular weight of from about 1,000 to about 10,000.

19. A toner composition in accordance with claim 1 wherein the wax is a polyolefin, or mixture of polyolefins.

20. A toner composition in accordance with claim 19 wherein the polyolefin is polyethylene or polypropylene.

21. A toner composition in accordance with claim 1 wherein the wax is a polyolefin, or mixture of polyolefins comprised of polyethylene and polypropylene.

22. A toner composition in accordance with claim 1 wherein the wax is present in an amount of from about 1 to about 10 weight percent.

23. A toner composition in accordance with claim 1 wherein the wax is present in an amount of from about 2 to about 7 weight percent.

24. A toner composition in accordance with claim 1 further containing a charge enhancing additive selected from the group consisting of distearyl dimethyl ammonium methyl sulfate, cetyl pyridinium halide, and stearyl phenethyl dimethyl ammonium tosylate.

25. A developer composition comprised of the toner composition of claim 4, and carrier particles.

26. A developer composition comprised of the toner composition of claim 1, and carrier particles.

27. A developer composition in accordance with claim 25 wherein the carrier particles are comprised of a core with a polymeric coating thereover.

28. A developer composition in accordance with claim 26 wherein the carrier particles are comprised of a core with a polymeric coating thereover.

29. A developer composition in accordance with claim 25 wherein the carrier particles are comprised of a steel or a ferrite core with a coating thereover selected from the group consisting of polychlorotrifluoroethylene-co-vinylchloride copolymer, a polyvinylidene fluoropolymer, a terpolymer of styrene, methacrylate, an organo silane, fluorinated ethylene-propylene copolymer, and polytetrafluoroethylene.

30. A method for obtaining images which comprises generating an electrostatic latent image on a photoconductive imaging member, subsequently affecting development of this image with the toner composition of claim 1, thereafter transferring the image to a permanent substrate, and optionally permanently affixing the image thereto.

31. A method for obtaining images which comprises generating an electrostatic latent image on a layered photoconductive imaging member, subsequently affecting development of this image with the toner composition of claim 1, thereafter transferring the image to a permanent substrate, and optionally permanently affixing the image thereto.

32. A toner composition in accordance with claim 1 wherein the compatibilizer is the block copolymer AB and wherein the weight average molecular weight of the polymeric segment A is from about 3,000 to about 50,000, and the weight average molecular weight of polymeric segment B is from about 1,000 to about 30,000 for the compatibilizer.

33. A toner composition in accordance with claim 1 wherein the compatibilizer is of the formula wherein the polystyrene block represents from about 50 weight percent to about 80 weight percent of the weight of the diblock polymer $$-\{-CH_2CH(Phenyl)\}_x\text{-block-}[-\{CH_2CH{=}C(CH_3)\text{-}CH_2\text{-}\}_a\text{-}\{\text{-}CH_2\text{-}CH\text{-}(CCH_3{=}CH_2)\text{-}\}_b\text{-}\{CH_2\text{-}CH_2\text{-}CH(CH_3)CH_2\text{-}\}_c\text{-}\{CH_2\text{-}CH\text{-}(CHCH_3\text{-}CH_3)\text{-}\}_d\text{-}]$$

where $28<x<481$, $14<(a+b+c+d)<441$, $b+d<0.1(a+b+c+d)$, and $(c+d)>0.5(a+b+c+d)$.

34. A toner composition in accordance with claim 1 wherein the first resin particles are polyesters, the pigment is carbon black, the wax is polypropylene, and the compatibilizer is a styrene isoprene diblock copolymer containing about 30 weight percent isoprene segments, and which diblock has been halogenated to convert about 60 weight percent of the isoprene segments to ethylene propylene units.

35. A toner composition consisting of first resin particles, optional second crosslinked resin particles, pigment, wax component particles, and a compatibilizer comprised of a diblock polymer of partially hydrogenated polystyrene/polyisoprene or a partially hydrogenated polystyrene/polybutadiene.

* * * * *